US005197225A

United States Patent [19]

Yff

[11] Patent Number: 5,197,225

[45] Date of Patent: Mar. 30, 1993

[54] RADIATION RESISTANT SLIDING DOOR

[75] Inventor: Robert Yff, Norwalk, Conn.

[73] Assignee: Panashield, RF and Audio Shielding, Inc., Norwalk, Conn.

[21] Appl. No.: 932,665

[22] Filed: Aug. 20, 1992

[51] Int. Cl.[5] ..... E05D 15/10

[52] U.S. Cl. ..... 49/223; 49/409; 49/410; 174/35 MS

[58] Field of Search ..... 49/209, 216, 221, 223, 49/409, 410, 411; 174/35 MS, 35 GC

[56] References Cited

U.S. PATENT DOCUMENTS 995,960 6/1911 Gray ..... 49/223 X
3,604,834 9/1971 Follett ..... 174/35 MS
4,688,352 8/1987 Kinoshita ..... 49/221 X
4,753,038 6/1988 Sohlström ..... 49/221 X
4,786,758 11/1988 Zielinski ..... 174/35 MS X
4,910,920 3/1990 Nichols ..... 174/35 MS X
5,017,736 5/1991 Yarger et al. ..... 174/35 MS

*Primary Examiner*—Philip C. Kannan
*Attorney, Agent, or Firm*—Edward R. Hyde

[57] ABSTRACT

A door closure mechanism comprising a frame and sliding door adapted to close a doorway to effect a shield against electromagnetic radiation and other environmental conditions. The sliding door is suspended for lateral movement and is adapted to bear against the frame and be secured to it to effect a seal.

14 Claims, 6 Drawing Sheets

RADIATION RESISTANT SLIDING DOOR

BACKGROUND OF THE INVENTION

1. Field of the Invention

The present invention relates to sealing devices for enclosures and more particularly to enclosures that seal or attenuate electromagnetic radiation, including RF radiation, sound, blast, gas and other environmental conditions.

There are numerous situations in which it is desirable to have an enclosure sealed from outside or inside for radio frequency or other electromagnetic radiation and conditions. In particular, in the testing of electrical apparatus it is necessary to have the equipment isolated from outside radiation and in such cases, enclosures are provided for the equipment under test. In other cases such as the transmission of information by electronic means, it is desirable to shield the apparatus from possible outside surveillance and in such cases radio frequency shielded enclosures are used.

A critical part of such enclosures is the doorway or other accesses which are opened to permit egress and ingress of persons or apparatus. The present invention is directed to an access construction (door) that is especially convenient and which provides an improved sealing of electromagnetic radiation.

2. Description of the Prior Art

Numerous shield system door constructions have been designed most of which provide hinged doors that close against a door frame and provide a slot on the frame and a plate on the door. When the door is closed the plate fits within the slot and a sealing strip is located within the slot to effect a radiation seal. Examples of this type of structure are shown in U.S. Pat. Nos., 3,589,070 and 4,069,618. The sealing element within the slot comprises a resilient strip of fingers that are secured within the slot and bear against the plate when the door is closed. This type of construction presents various disadvantages such as the bending and breaking of the various fingers and a certain leakage of electromagnetic radiation through the door seal.

Another type of construction contemplates an inflatable member within a slot-plate type door and frame in which the member is inflated to effect a seal. Examples of this type of construction are shown in U.S. Pat. Nos. 3,604,834 and 4,371,175 and 4,399,317.

As noted above, the typical door construction for electromagnetic sealed enclosures are hinged. An example of a sliding door is shown in U.S. Pat. No. 3,604,834 which employs an inflatable bladder in an attempt to effect a seal.

SUMMARY OF THE INVENTION

The electromagnetic radiation sealing door of the present invention contemplates a hanging sliding door adapted to be slid to a position where it coincides with a door frame secured to the enclosure walls and slid to an open position to permit entry to the enclosure.

When closure is desired, the door is slid to its position in front of the door frame. In this position a series of actuating elements which may be hydraulically operated and secured to the frame engage a series of cooperating fingerlike elements to effect lateral movement of the hanging door in a direction to and up against the door frame.

A resilient strip of electroconductive material or other media is provided around the periphery of the door where the periphery engages the door frame. This resilient strip is tightly pulled against the door frame and serves as a shielding element when the door is closed.

Accordingly it is a primary object of the present invention to provide a door construction for an enclosure that effectively seals electromagnetic radiation from the enclosure.

It is a further object of the present invention to provide an improved door construction including a sliding door for an electromagnetically sealed enclosure that is efficient and effective in sealing electromagnetic radiation from the enclosure.

It is a still further object of the present invention to provide a sliding door for an electromagnetically sealed enclosure that is convenient and efficient in operation.

BRIEF DESCRIPTION OF THE DRAWINGS

The foregoing and still other objects and advantages of the present invention will be more apparent from the following detailed explanation of the preferred embodiments of the invention considered in connection with the accompanying drawings herein in which.

DESCRIPTION OF THE PREFERRED EMBODIMENT

Throughout the description reference is made to electromagnetic radiation shielding but it is understood that the invention is also applicable to shielding of other environmental conditions as sound, blast, gas, etc.

Figure 1:
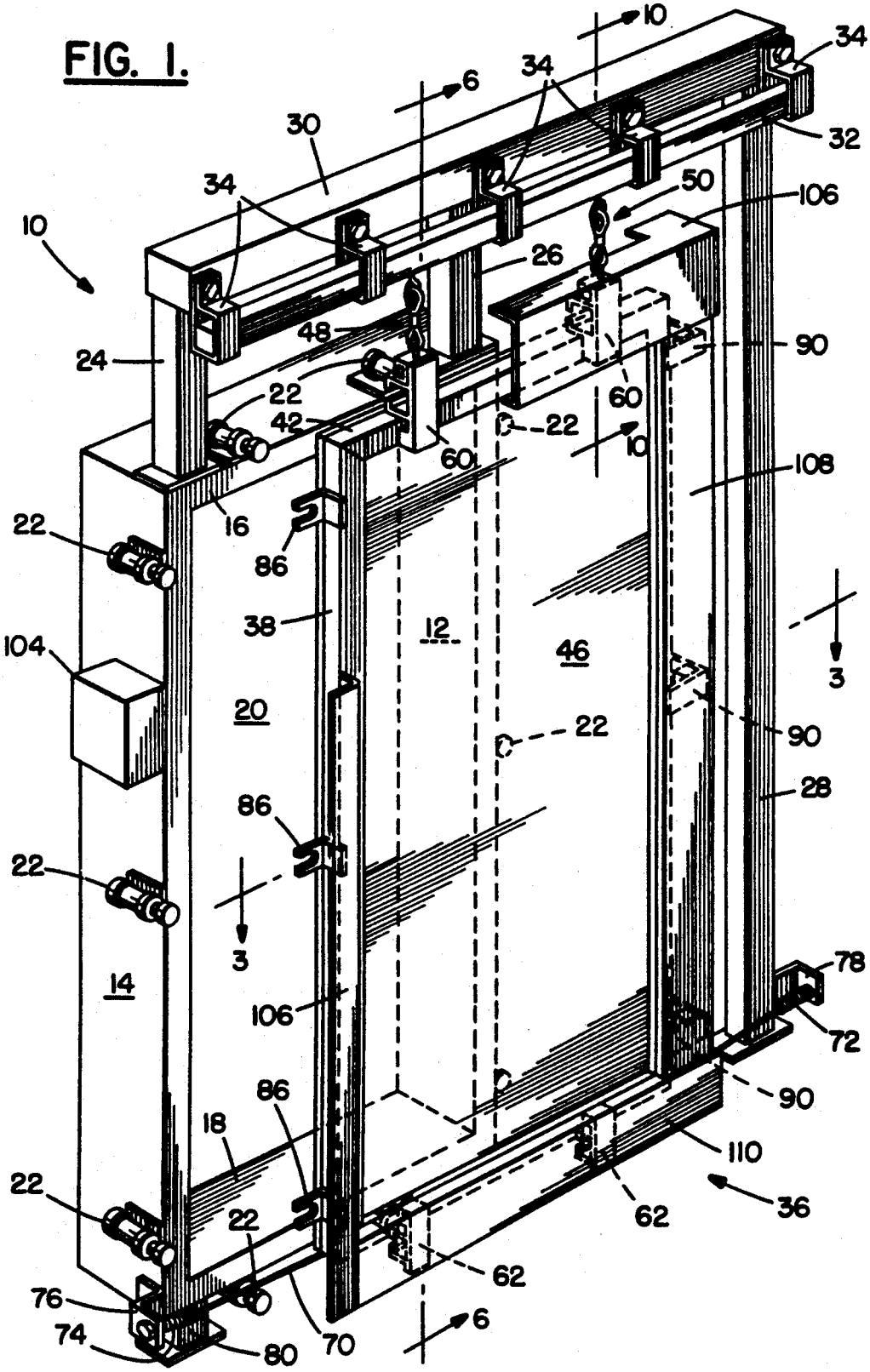
FIG. 1 is a perspective view of the door construction of the present invention.

Referring now to the drawings and more particularly to FIG. 1 numeral 10 indicates a door frame which may be secured to the wall of an enclosure (not shown) which is to be free of electromagnetic energy. The frame is comprised of sides 12, 14, top 16 and bottom member 18 which may be made of steel and welded together to form a rectangular structure. The frame defines an open doorway 20 for entering and leaving the enclosure. It is of course understood that the doorway may be of any desired size from as small as a square foot or smaller, to large enough for a vehicle such as an automobile or even an airplane to pass through the opening.

The frame has a number of hydraulic cylinders with pistons indicated as numerals 22 secured as by bolting to the outer surfaces of the four structural members making up the frame. In the embodiment shown there are three such hydraulic units secured to each of the sides and two units secured to each of the top and bottom members.

The frame also includes a framework of members 24, 26 and 28 which support a horizontal member 30. This framework is also made of steel members and secured together as by welding. Member 30 supports a track 32 by means of brackets 34. It is seen then that the door frame 10 and the structural framework for the track 32 are constructed as a single unit welded and bolted together and which may be conveniently transported to the location of the enclosure having the door opening for which the unit is designed. The frame structure is then welded to the enclosure to define the doorway for access to the enclosure.

Figure 2:
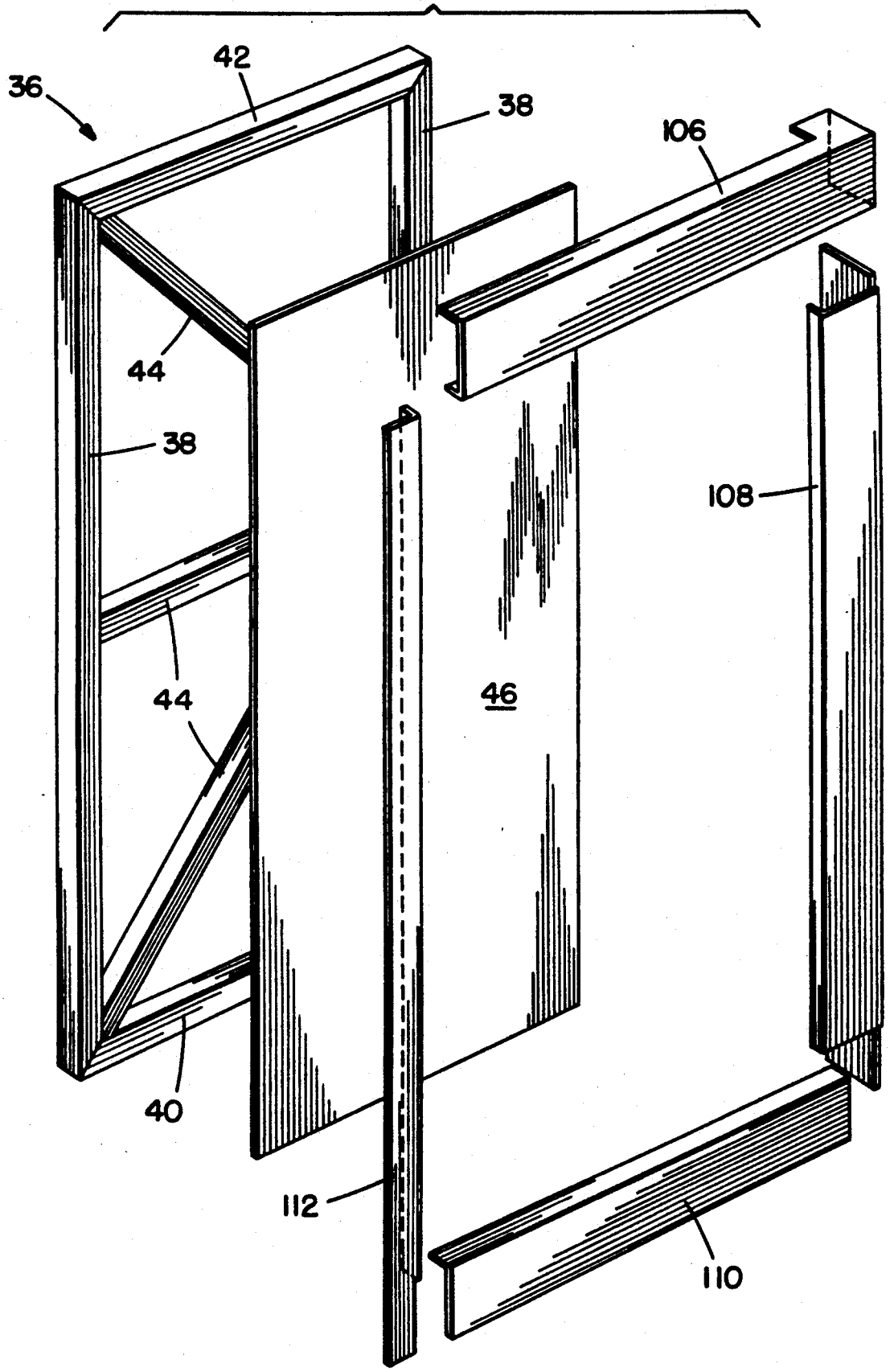
FIG. 2 is an exploded view of the sliding door and certain associated structure.

The door structure is generally indicated by numeral 36 and more clearly shown in the exploded view of FIG. 2. It includes a rectangular frame of sides 38, bottom 40 and top member 42. To provide rigidity stiffening members 44 are secured within the door frame and a panel 46 closes the door opening and is secured to the door frame members. All of the elements of the door are made of steel or other structurally strong electroconductive material and are welded together.

Figure 10:
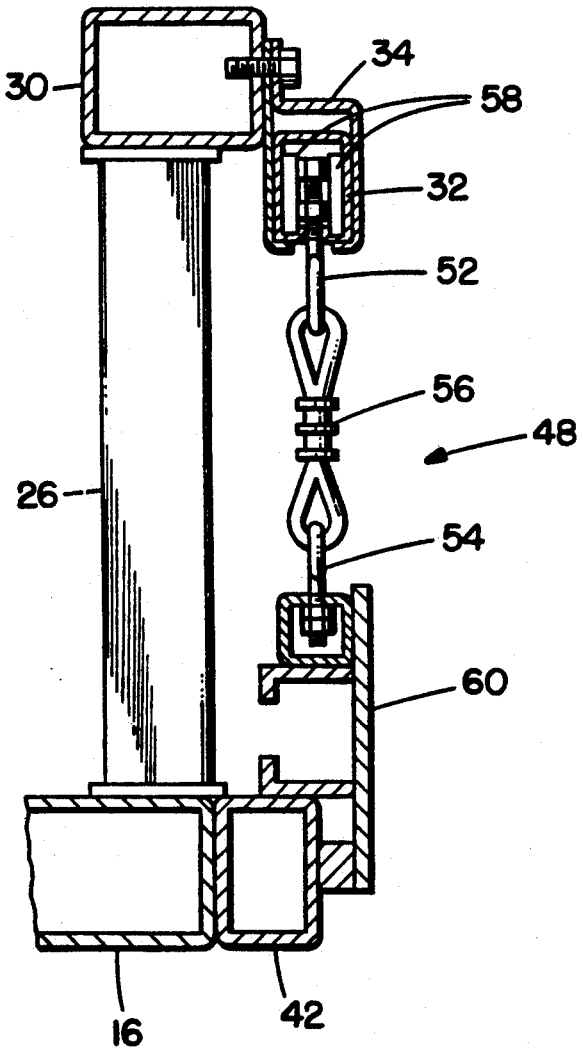
FIG. 10 is a section taken on the line 10—10 of FIG. 1.
Figure 11:
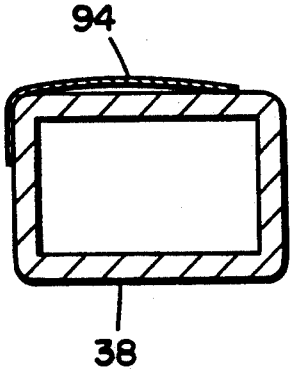
FIG. 11 is a sectional view of the leading edge of the door frame.

The door is supported by hangers 48, 50 which as shown in FIG. 10 include eye bolts 52, 54 and a short length of cable or double clevis 56 having two eyes that are received by the eye bolts 52, 54. The upper eye bolt passes through a slot in the underside of track 34 and includes sliding members 58 secured to the eye bolt 52 that run along the undersurface of the track. The other end of the hangers are each secured to a door bracket 60 which in turn is welded to the door. It is seen then that the door 36 is suspended by hangers 48, 50 for sliding movement along track 32. The door may be slid to the right as seen in FIG. 1 to open the doorway through the door frame and alternatively it may be slid to the left to cover the doorway opening.

Figure 6:
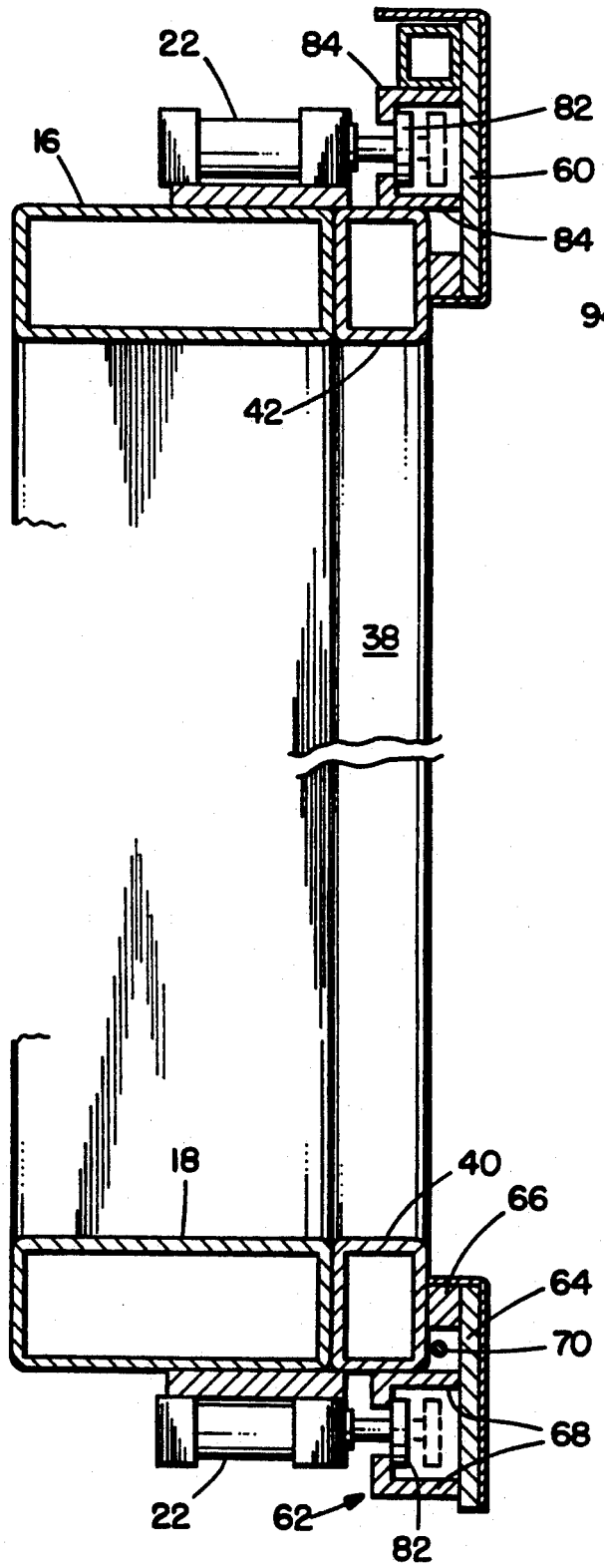
FIG. 6 is a section taken on the line 6—6 of FIG. 1.
Figure 7:
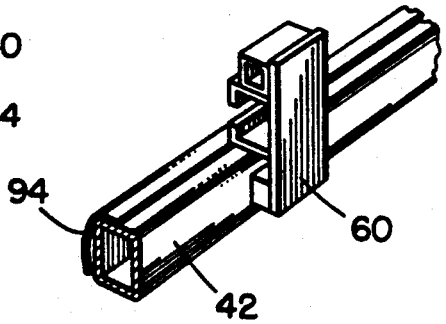
FIG. 7 is a perspective view of a portion of the upper door frame.
Figure 8:
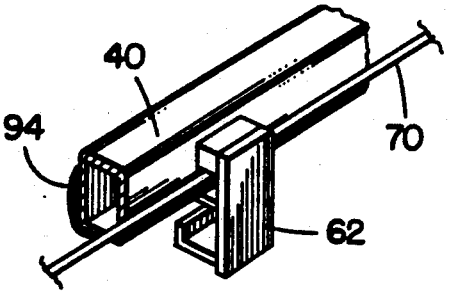
FIG. 8 is a perspective view of a portion of the lower door frame.

Secured to the bottom of the door are a pair of brackets 62 which as shown in FIG. 6 comprise members 64, 66 and 68 welded together as a unitary bracket structure. In order to prevent the bottom of the door from swinging out and away from its normal position a wire rope 70 is provided having springs 72, 74 secured to brackets 76, 78 which in turn are secured respectively to a short leg 80 welded to the bottom of the door frame and the leg 28 that depends from support 30. The wire passes through the brackets 62 as more clearly seen in FIGS. 1 and 6.

Each of the brackets 62 as noted above include a channel-like member 68 which provides a pair of fingers. Each of the hydraulic cylinders 22 includes a piston terminating in a disk 82 which is adapted to be received by the fingers 68 when the door 36 is slid to its closed position.

Similarly brackets 60 secured to the upper portion of the door include finger members 84 that receive the disk 82 of the associated cylinder piston.

The leading edge 38 of the door has three U-shaped members 86 secured thereto which are adapted to be received by the respective three hydraulic cylinders 22 secured to the door jamb member 14.

Figure 3:
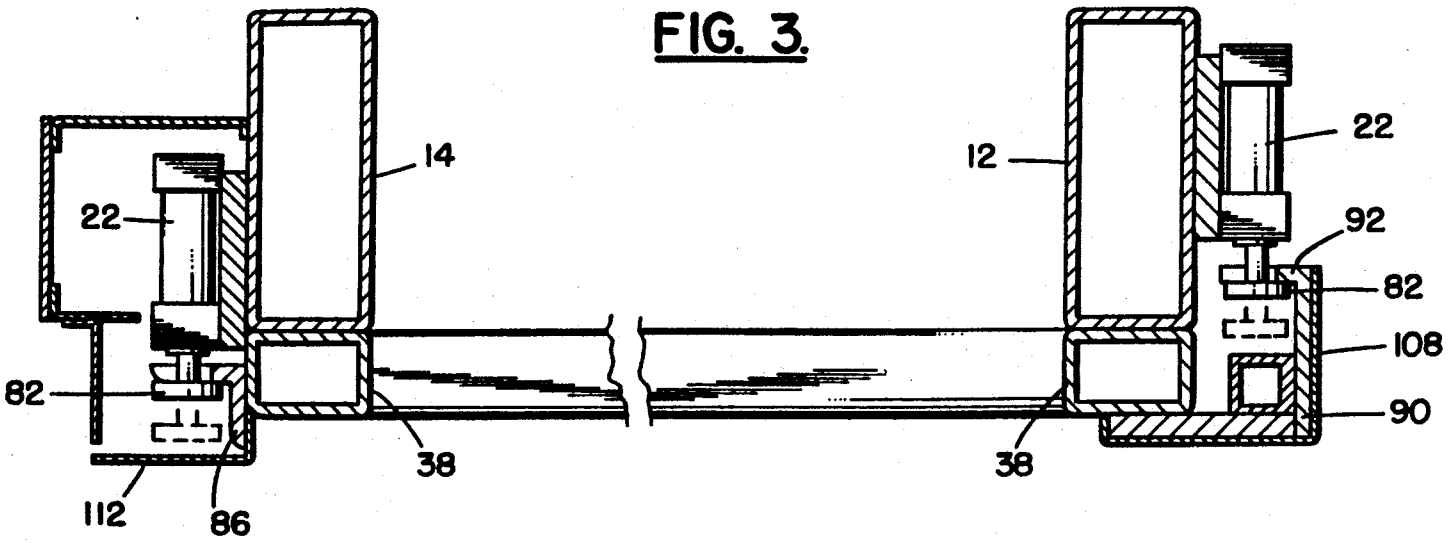
FIG. 3 is a section taken on the line 3—3 of FIG. 1.
Figure 5:
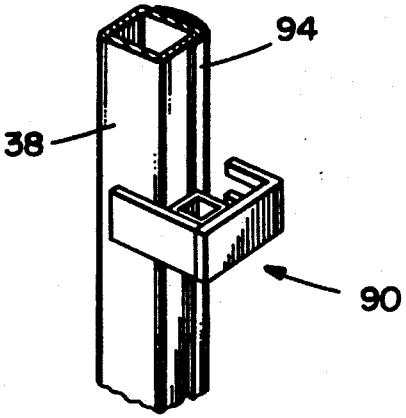
FIG. 5 is a perspective view of a portion of the trailing edge of the door frame.

Referring to FIGS. 1 and 5, the trailing edge of the door which is formed of member 38 has secured thereto three L-brackets 90 one of which is shown in section in FIG. 3. The L-bracket 90 includes a finger 92 which is received by the piston of the associated hydraulic cylinder 22 in the same manner that upper brackets 60 and lower brackets 62 are received by their associated hydraulic cylinders.

Figure 4:
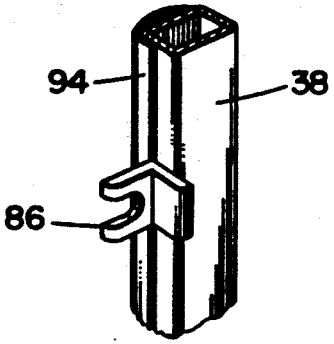
FIG. 4 is a perspective view of a portion of the leading edge of the door frame.

An important feature of this invention is a resilient spring-like strip 94 that is secured around the internal periphery of the door 36. That is, spring strip 94 is made of four sections secured to door members 38, 40 and 42. Referring now to FIGS. 4 and 5 there is shown the spring strip sections 94 secured to the side members 38 of the door. It is seen that the strip is somewhat L-shaped having a short arm and a longer arm. The construction contemplates the short arm being welded to the outer edge of side member 38 and the longer arm of the strip being held against the inner surface of the side door members. In this manner when the door is pulled against the door frame the longer arm or portion of the spring strip 94 is compressed between the outer rectangular edge of the door frame and the inner rectangular edge of the door to provide an electromagnetic seal. Similarly the upper door member 42 and the lower door member 40 have sections of the spring strip secured in the same manner with the result that when the door is closed against the frame there is a complete rectangular seal provided by the compression of the spring strip.

When the door is slid to the left the upper brackets 60, lower brackets 62, trailing edge brackets 90 and leading edge members 86 are all received by the cylinders of the pistons 22. At this time the operator will cause the cylinders to actuate to retract their respective pistons such that their respective end disks 82 will pull all two sides and top and bottom of the door tightly against the door frame providing a tight electromagnetic seal.

Figure 9:
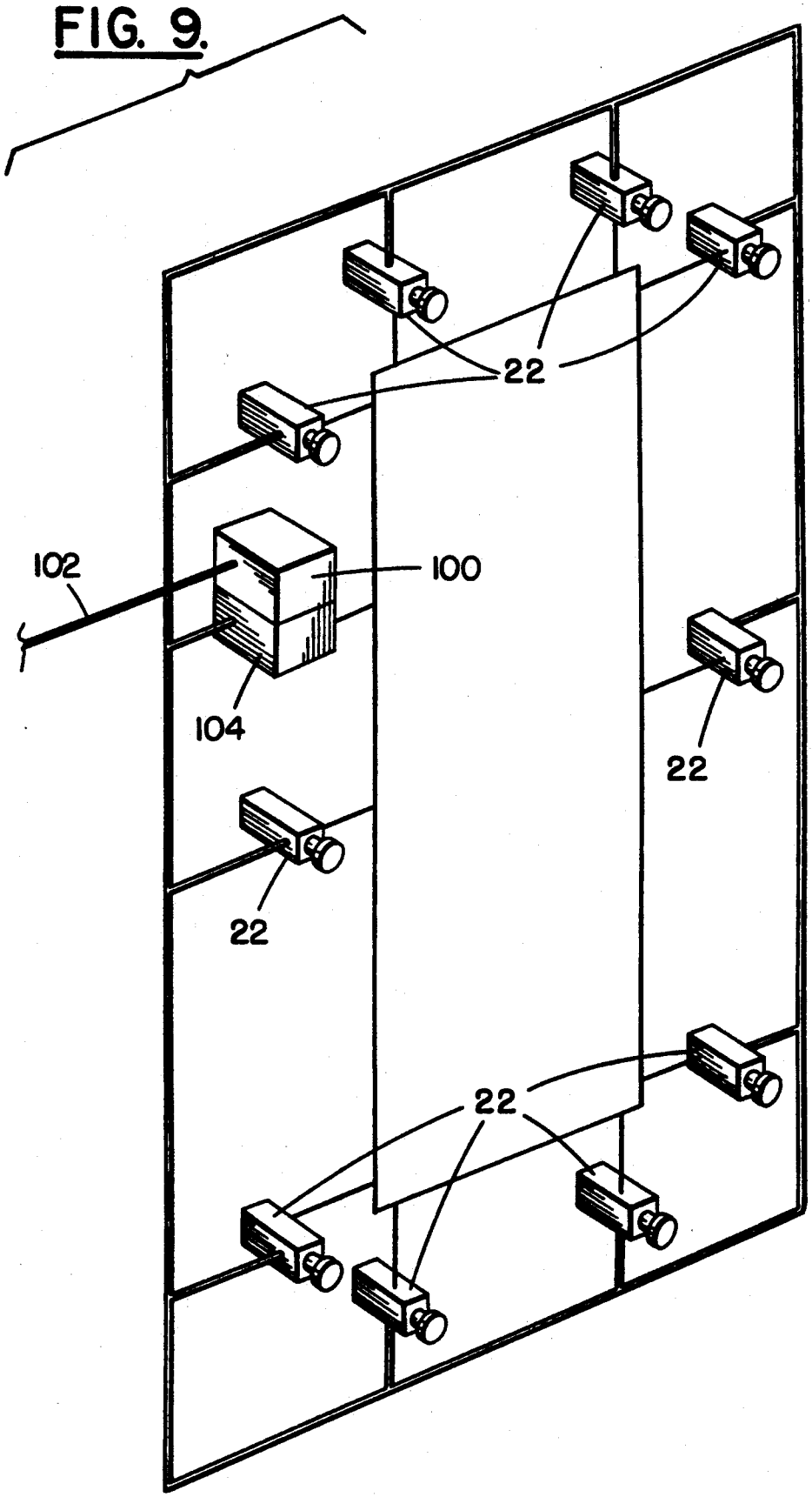
FIG. 9 is a schematic of the hydraulic closing devices and hydraulic system.

FIG. 9 is a schematic of the hydraulic system showing the cylinders 22 and their control mechanism 100 which is tied to an electrical source 102 and a source of fluid 104. The hydraulic system is controlled by a panel 104 conveniently secured to the side of the door frame. It is understood that the hydraulic mechanism may be of any conventional design and hence is shown schematically.

As a safety factor, a rectangular shield is provided to cover certain of the door brackets. This is formed of members 106, 108, 110 and 112 as shown in FIGS. 1 and 2. These members are suitably secured to the door along its outer edges and serve to cover brackets 60, 62, 90 and finger elements 86.

Having thus described the invention with particular reference to the preferred forms thereof, it will be obvious that various changes and modifications may be made therein without departing from the spirit and scope of the invention as defined in the appended claims.

What is claimed is:

1. A door closure mechanism comprising:

a door frame defining a doorway;

a track secured above said door frame;

a door having peripheral frame members;

means connected to the upper portion of the door and slidable in the track whereby the door hangs from the track and is slidable to a first position coinciding with the door frame and to a second position to open the doorway;

a plurality of movable means secured to the door frame on the periphery thereof;

a plurality of cooperating means equal in number to the movable means secured to the periphery of the door and adapted to cooperate with the plurality of movable means when the door is in the said first position;

resilient strip means secured to the periphery of the door; and means to activate the movable means to engage the cooperating means on the door to move the door laterally against the door frame whereby the resilient strip means is gripped between the door and the door frame to provide a radiation resistant joint.

2. The structure of claim 1 in which the movable means comprises hydraulic cylinder and piston means.

3. The structure of claim 1 in which said movable means comprises a plurality of individual movable members secured to both sides, top and bottom of the door frame at predetermined intervals.

4. The structure of claim 3 including supporting means secured to the said door frame and to the said track to secure the track in a substantially horizontal position.

5. The structure of claim 4 including retaining means cooperating with the bottom of the door to restrain outward swinging thereof.

6. An electromagnetic radiation resistant door closure mechanism comprising:

a door frame defining a doorway;

a door having peripheral frame members;

means to provide slidable movement of the door to a first position coinciding with the door frame and to a second position to open the doorway;

a plurality of movable means secured to the door frame on the periphery thereof;

a plurality of cooperating means, equal in number to the movable means, secured to the periphery of the door and adapted to cooperate with the plurality of movable means when the door is in the said first position;

electroconductive resilient strip means secured to the periphery of the door; and means to activate the movable means to engage the cooperating means on the door to move the door laterally against the door frame whereby the resilient strip means is gripped between the door and the door frame to provide a radiation resistant joint.

7. The structure of claim 6 in which said movable means comprises a plurality of individual movable members secured to both sides, top and bottom of the door frame at predetermined intervals.

8. The structure of claim 7 in which the resilient strip means extends along the inside of the peripheral frame members.

9. The structure of claim 8 in which the resilient strip means is L-shaped and extends along the outside edge of the peripheral frame members.

10. The structure of claim 9 in which the resilient strip means is secured to the peripheral frame members along the outside edge thereof.

11. A radiation resistant door closure mechanism comprising:

a rectangular door frame defining a doorway having sides, bottom and top;

a track secured above said door frame;

a rectangular door having sides, bottom and top peripheral frame members;

hanging means connected to the top peripheral frame member of the door and slidable in the track whereby the door hangs from the track and is slidable to a first position coinciding with the rectangular door frame and to a second position to open the doorway;

a plurality of movable means secured to the door frame on the sides, bottom and top thereof;

a plurality of cooperating means equal in number to the movable means secured to the sides, bottom and top of the door frame and adapted to cooperate with the plurality of movable means when the door is in the said first position;

electroconductive resilient strip means secured to the periphery of the door; and means to activate the movable means to engage the cooperating means on the door to move the door laterally against the door frame whereby the resilient strip means is gripped between the door and the door frame to provide a radiation resistant joint.

12. The structure of claim 11 in which the resilient strip means extends along the inside of the sides, bottom and top peripheral frame members.

13. The structure of claim 12 in which the resilient strip means is L-shaped and extends along the outside edge of the sides, bottom and top peripheral frame members.

14. The structure of claim 13 in which the resilient strip means is secured to the sides, bottom and top peripheral frame members along the outside edges thereof.

* * * * *